US005399469A

United States Patent [19]

Szajewski

[11] Patent Number: 5,399,469

[45] Date of Patent: Mar. 21, 1995

[54] SPATIALLY FIXED ABSORBER DYES IN LESS SENSITIVE LAYERS

[75] Inventor: Richard P. Szajewski, Rochester, N.Y.

[73] Assignee: Eastman Kodak Company, Rochester, N.Y.

[21] Appl. No.: 135,699

[22] Filed: Oct. 13, 1993

[51] Int. Cl.[6] ..... G03C 1/46

[52] U.S. Cl. ..... 430/506; 430/504; 430/503; 430/505; 430/507; 430/544; 430/567; 430/517

[58] Field of Search ..... 430/506, 504, 503, 507, 430/517, 505, 544, 567

[56] References Cited

U.S. PATENT DOCUMENTS

| | | | |
|---|---|---|---|
| 3,450,536 | 6/1969 | Wyckoff | 430/505 |
| 3,663,228 | 5/1972 | Wyckoff | 430/507 |
| 3,812,507 | 5/1974 | Wyckoff | 430/506 |
| 3,849,138 | 11/1974 | Wyckoff | 430/507 |
| 4,233,399 | 11/1980 | Kitzing et al. | 430/510 |
| 4,312,941 | 1/1982 | Scharf et al. | 430/510 |
| 4,388,401 | 6/1983 | Hasebe et al. | 430/505 |
| 4,391,884 | 7/1983 | Meyer et al. | 430/17 |
| 4,520,098 | 5/1985 | Dickerson | 430/495 |
| 4,539,289 | 9/1985 | Saito et al. | 430/506 |
| 4,582,780 | 4/1986 | Giusto et al. | 430/505 |
| 4,746,600 | 5/1988 | Watanabe et al. | 430/505 |
| 4,865,964 | 9/1989 | Newmiller | 430/367 |
| 4,885,220 | 12/1989 | Kuhman et al. | 430/31 |
| 4,948,717 | 8/1990 | Diehl et al. | 430/510 |
| 4,977,069 | 12/1990 | Iijima et al. | 430/506 |
| 5,009,988 | 4/1991 | Yagi et al. | 430/505 |
| 5,268,262 | 12/1993 | Shibahara et al. | 430/506 |
| 5,275,929 | 1/1994 | Buitano et al. | 430/507 |
| 5,302,499 | 4/1994 | Merrill et al. | 430/503 |
| 5,308,747 | 5/1994 | Szajewski et al. | 430/517 |

FOREIGN PATENT DOCUMENTS 1021564 3/1966 United Kingdom .

*Primary Examiner*—Charles L. Bowers, Jr.
*Assistant Examiner*—Geraldine Letscher
*Attorney, Agent, or Firm*—Paul A. Leipold

[57] ABSTRACT

This invention relates to color photographic elements and processes and especially to color photographic elements comprising two or more image forming layers sensitized to the same region of the electromagnetic spectrum where a more sensitive layer is positioned closer to an exposure source than a less sensitive layer and the less sensitive layer additionally comprises a spatially fixed absorber dye. The combination provides improved image sharpness without compromising photographic sensitivity.

20 Claims, 2 Drawing Sheets

SPATIALLY FIXED ABSORBER DYES IN LESS SENSITIVE LAYERS

FIELD OF THE INVENTION

This invention relates to color photographic elements and processes and especially to color photographic elements comprising two or more image forming layers spectrally sensitized to the same region of the electromagnetic spectrum where a more sensitive layer is positioned closer to an exposure source than a less sensitive layer and the less sensitive layer additionally comprises a spatially fixed absorber dye. The combination provides improved image sharpness without compromising photographic sensitivity.

BACKGROUND OF THE INVENTION

Among the desirable properties of a silver halide photographic element is high sharpness; that is, the element should enable faithful reproduction and display of both coarse and fine details of an original scene. Another desirable property of a photographic element is high overall sensitivity. This combination of properties has proven difficult to achieve in practice.

A general description of the difficulty in achieving high levels of sharpness may be found in T. H. James, ed., "The Theory of the Photographic Process," Macmillan, New York, 1977 and, in particular, at Chapter 20 of this text, pages 578–591, entitled "Optical Properties of the Photographic Emulsion" by J. Gasper and J. J. DePalma.

One method of improving sharpness, disclosed at U.S. Pat. Nos. 4,312,941 and at 4,391,884, involves the incorporation of a spatially fixed absorber dye in a film layer between the exposing light source and any layer comprising a conventional grain light sensitive silver halide emulsion sensitive to the region of the electromagnetic spectrum absorbed by the spatially fixed absorber dye. In these disclosures, the absorber dye is held spatially fixed either by means of a ballast group or by means of a mordanting material incorporated at a specified position in the film structure. Use of this spatial arrangement of absorber dye and emulsion reduces front-surface halation effects; that is, the spatially fixed dye absorbs light that has been reflected from an emulsion layer thus minimizing re-exposure at a position other than that intended. This positioning of spatially fixed dye has the difficulty that purposeful exposure is also attenuated and film sensitivity is degraded.

U.S. Pat. Nos. 4,746,600 and 4,855,220 disclose that larger degrees of sharpness can be attained by combining spatially fixed absorber dyes and Development Inhibitor Releasing Compounds (DIR Compounds) in a photographic silver halide recording material. The spatially fixed absorber dye is positioned between any emulsion layer sensitive to the region of the electromagnetic spectrum absorbed by the spatially fixed absorber dye containing layer and the exposing light source. This combination still suffers undesireably large degrees of film sensitivity loss.

U.S. patent application Ser. No. 869,987 filed Apr. 16, 1992 discloses that even larger improvements in sharpness can be attained by employing a spatially fixed absorber dye in a layer positioned between an exposure source and any layer comprising a sensitized high aspect ratio tabular shaped silver halide emulsion sensitized to the same region of the electromagnetic spectrum.

Again, film sensitivity losses are encountered in this approach.

In a related area, U.S. Pat. Nos. 3,450,536; 3,663,228; 3,812,507; and 3,849,138 as well as British Patent GB 1,021,564 disclose the use of density layers placed between layers comprising emulsions sensitized to the same region of the electromagnetic spectrum for the purpose of increasing photographic latitude. The emulsions employed at the time of these publications were generally symmetrical and would today be described as having aspect ratios of about one. No mention is made in these publications of improved sharpness.

In yet another related area, U.S. Pat. No. 4,956,269 discloses that color reversal silver halide photographic elements incorporating tabular grain silver halide emulsions that have been developed using a reversal process can show improved sharpness under narrowly specified conditions. These conditions are met when the photographic color record incorporating the tabular grain silver halide emulsion also incorporates a quantity of absorber dye sufficient to reduce the sensitivity of that color record by at least 20%, when the total imaging layer thickness is less than 16 microns and when the swell ratio of the film is greater than 1.25. The materials described in this disclosure incorporate intermediate aspect ratio ( $AR<9.0$) tabular grain silver halide emulsions. These conditions and constraints are non-predictive of the performance of color negative silver halide photographic materials. The absorber dyes described in this disclosure are solubilized dyes that distribute indiscriminantly throughout a film element. Large film sensitivity losses are again encountered in this approach.

U.S. patent application Ser. No. 869,675 filed Apr. 16, 1992 discloses that even larger degrees of sharpness improvement are attained when high aspect ratio tabular shaped silver halide grains are employed in combination with absorber dyes in a common layer, and that especially high degrees of sharpness enhancement are obtained when a color negative development process is employed in this case. The absorber dyes described in this disclosure are distributed indiscriminantly throughout a film element. Large film sensitivity losses remain inherent in this approach.

PROBLEM TO BE SOLVED BY THE INVENTION

Despite all of this effort, fully adequate degrees of sharpness have not been attained in silver halide photographic materials without suffering undue sensitivity losses. The problem of providing high photographic sharpness without suffering large sensitivity losses remains to be solved.

SUMMARY OF THE INVENTION

It is an object of this invention to provide an improved photographic element exhibiting both high sharpness and good sensitivity.

It is an additional object of this invention to provide an image forming method enabling the formation of a photographic image exhibiting high sharpness while maintaining high photographic sensitivity.

Generally the invention is accomplished by providing a photographic element comprising a support bearing at least two light sensitive silver halide layers wherein:

said layers are sensitive to the same region of the electromagnetic spectrum; and the more light sensitive layer of said at least two light sensitive layers is closer to an exposure source than a less light sensitive layer of said at least two light sensitive layers; and said less light sensitive layer comprises a spatially fixed absorber dye that absorbs light in substantially the same region of the electromagnetic spectrum as said light sensitive silver halide; wherein said spatially fixed absorber dye does not substantially contribute to the spectral sensitivity of said less sensitive silver halide layer.

The object of this invention is further provided by:

a method of forming a color image comprising the step of developing an imagewise exposed color photographic element using a paraphenylene diamine developing agent to produce a color negative image;

said color photographic element comprising a support bearing at least two light sensitive silver halide layers wherein:

said layers are sensitive to the same region of the electromagnetic spectrum and have in reactive association image dye forming couplers, wherein:

a more light sensitive layer of said at least two light sensitive layers is closer to the exposure source than a less light sensitive layer of said at least two light sensitive layers; and said less light sensitive layer comprises a spatially fixed absorber dye that absorbs light in substantially the same region of the electromagnetic spectrum as said light sensitive silver halide; wherein said spatially fixed absorber dye does not substantially contributing to the spectral sensitivity of said less sensitive silver halide layer.

In an especially preferred embodiment, the photographic element comprises three or more light sensitive silver halide layers spectrally sensitized to substantially the same region of the spectrum which form a common color record.

ADVANTAGEOUS EFFECT OF THE INVENTION

The element and method as described provide improved image sharpness while minimizing sensitivity loss.

This invention has many advantages over prior photographic elements. The invention allows the effective use of the speed of silver halide grains while providing very good sharpness of images. Surprisingly the use of the spatially fixed absorber dyes in the same layer as emulsions sensitive to the color absorbed by the dyes but in a layer further from an exposure source than the most sensitive layer in that color record provides improved sharpness with only a small loss in speed. Prior to this invention it had not been realized that improved sharpness could be attained without an excessive loss in photographic sensitivity. The improvement obtained by this invention may be achieved without interference with the composition of the silver halide emulsion grains, thereby decreasing the possibilities of reaction with the emulsion layers. These and other advantages of the invention will be apparent from the detailed description below.

DETAILED DESCRIPTION OF THE INVENTION

Figure 1:
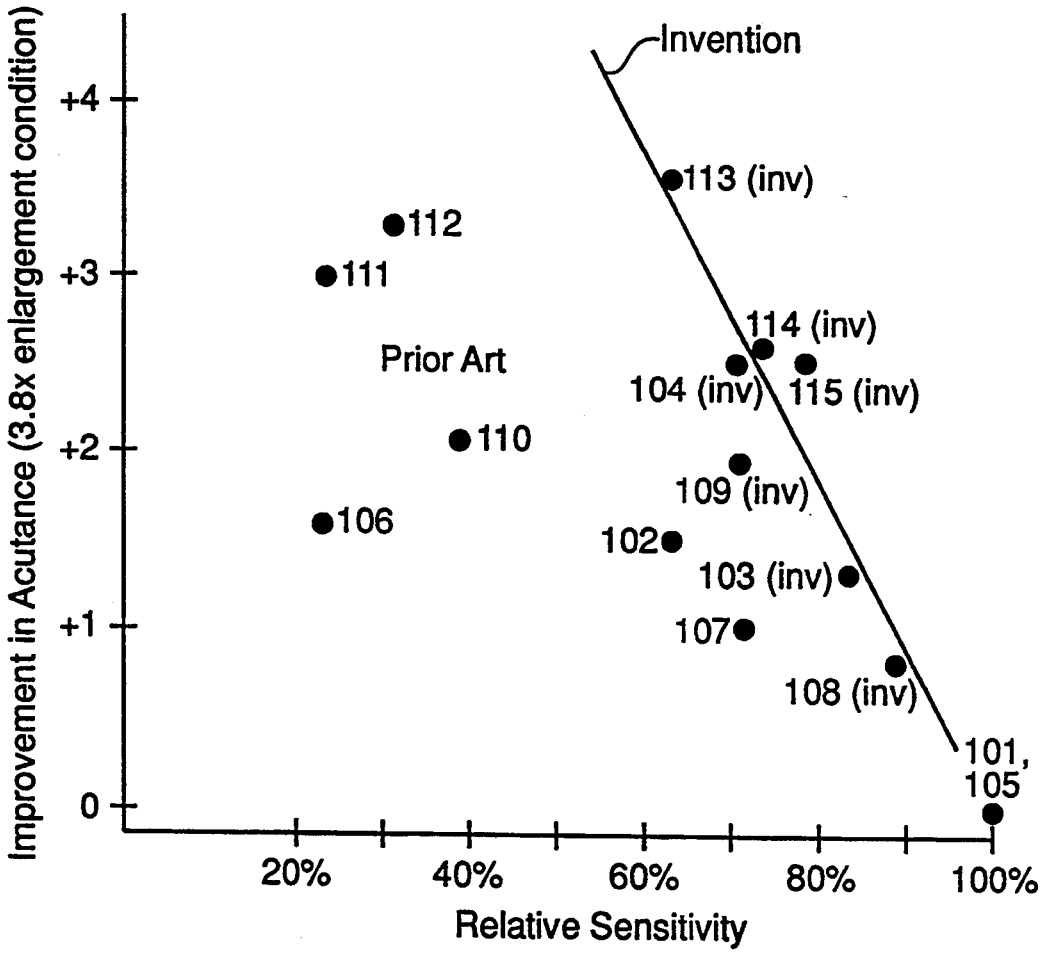
FIG. 1 and FIG. 2 are graphical representations of the data in Table 1.

In a photographic element the "most sensitive layer" in a record is the layer that comprises the silver halide most sensitive to the spectral region to which the record as a whole is sensitized.

As used herein, the terms "record" and "color record" refer to one or more silver halide containing layers sensitive to the same region of the electromagnetic spectrum.

In performing the invention, it is necessary that the spatially fixed dye be positioned in a silver halide emulsion layer whose sharpness is intended to be improved and that this layer be further from the upper surface of the photographic element than the most sensitive layer of the same color record. As used herein, the term "upper surface" or top refers to the surface directed toward the exposure light, while the lower portion or bottom of the photographic element is that portion towards the base and away from the direction of exposure. The spatially fixed dye absorbs the same color light as the silver halide emulsion whose improvement in sharpness is intended. In other words, if a silver halide emulsion is in the yellow layer which is sensitive to blue light, then the spatially fixed dye also needs to absorb blue light in order to effect the improvement in sharpness of the blue layer. Also, if improvement in the cyan layer which is sensitive to red light is desired, then the spatially fixed dye needs to absorb red light in order to effect the improvement in sharpness of the red layer. Likewise, if improvement in the magenta layer which is sensitive to green light is desired, then the spatially fixed dye needs to absorb green light in order to effect the improvement in sharpness of the green layer.

The layers of the invention generally are on the same side of a support. The layers may be contiguous or there may be intervening layers. When there are intervening layers, these intervening layers may contain light sensitive emulsions.

As used herein, blue light means light of about 400 to 500 nm wavelength, green light means light of about 500 to 600 nm wavelength, and red light means light of about 600 to 700 nm wavelength.

As set forth the use of the invention relating to spatially fixed dyes may also be combined with other improvements in a photographic element involving diffusible dyes that also are absorbing of red, green, and blue and with particularly preferred silver halide emulsions and emulsion grain dimensions that result in superior performance.

The photographic elements of this invention can be either single color or multicolor elements. Multicolor elements typically contain dye image-forming records sensitive to each of the three primary regions of the spectrum. In some cases the multicolor element may contain records sensitive to other regions of the spectrum or to more than three regions of the spectrum. Each record can be comprised of a single emulsion layer or of multiple emulsion layers sensitive to a given region of the spectrum. The layers of the element, including the layers of the image-forming records, can be arranged in various orders as known in the art.

A typical multicolor photographic element comprises a support bearing a cyan dye image-forming record comprising at least one red-sensitive silver halide emulsion layer having associated therewith at least one cyan dye-forming coupler, a magenta image forming record comprising at least one green-sensitive silver halide emulsion layer having at least one magenta dye-forming coupler and a yellow dye image-forming record comprising at least one blue-sensitive silver halide emulsion layer having associated therewith at least one yellow dye-forming coupler. In some instances it may be advantageous to employ other pairings of silver halide emulsion sensitivity and dye image-forming couplers, as in the pairing of an infra-red sensitized silver halide emulsion with a magenta dye-forming coupler or in the pairing of a blue-green sensitized emulsion with a coupler enabling minus-cyan dye formation. The material can contain additional layers, such as filter layers, interlayers, overcoat layers, subbing layers, and the like.

The layers of the material above the support may have a total thickness of between about 5 and 30 microns. It is generally preferred to minimize the thickness of the element above the support so as to improve sharpness and improve access of processing solutions to the components of the element. For this reason, thicknesses of less than 25 microns are preferred and thicknesses of less than 20 microns are even more preferred. These lowered thicknesses can be especially enabled at manufacture by use of surfactants and polymeric and other coatings aids as known in the art so as to control viscosity and shear. Both sharpness and ease of processing may be further improved by minimizing the quantity of incorporated silver in the element. The total silver content of the material may be between about 1 and 10 grams per square meter. Total silver of less than about 7 grams per square meter are preferred and total silver of less than about 5 grams per square meter are even more preferred. Sharpness in color images is further improved by complete removal of silver and silver halide from the element on processing. Since more swellable elements enable better access of components of processing solutions to the elements of this invention, swell ratios above 1.25 are preferred, with swell ratios of between 1.4 and 6 being more preferred and swell ratios of between 1.7 and 3 being most preferred. The balance of total thickness, total silver and swell ratio most suitable for an element intended for a specific purpose being readily derived from the image structure, color reproduction, sensitivity and physical integrity and photographic resistance to pressure required for that purpose as known in the art. Use of polymeric materials and gelatin levels as known in the art to further control these photographic and physical properties is recommended.

In the following discussion of suitable compounds for use in the element of this invention, reference will be made to *Research Disclosure,* December 1989, Item 308119, published by Kenneth Mason Publications, Ltd., The Old Harbourmaster's 8 North Street, Emsworth, Hampshire P010 7DD, ENGLAND, the disclosure of which are incorporated herein by reference. This publication will be identified hereafter by the tern "Research Disclosure".

The silver halide emulsions employed in the element of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains.

The sensitized silver halide emulsions useful in this invention include tabular grain emulsions disclosed by Kofron et alia in U.S. Pat. No. 4,439,520 and in the additional references cited below. These tabular grain silver halide emulsions and other emulsions useful in the practice of this invention can be characterized by geometric relationships, specifically the Aspect Ratio and the Tabularity. The Aspect Ratio (AR) and the Tabularity (T) are defined by the following equations:

$$AR = \frac{\text{Equivalent Circular Diameter}}{\text{Thickness}}$$

$$T = \frac{\text{Equivalent Circular Diameter}}{\text{Thickness} \times \text{Thickness}}$$

where the equivalent circular diameter and the thickness of the grains, measured using methods commonly known in the art, are expressed in units of microns.

Tabular Grain Emulsions of this invention can have an AR between about 2 and 25,000. Tabular Grain Emulsions with an aspect ratio greater than about 5 are preferred, and those with an aspect ratio greater than about 8 are especially useful. Most preferred are emulsions with an aspect ratio between about 10 and 2,500. These useful emulsions additionally can be characterized in that their Tabularity is greater than 25 and they are preferred to have a tabularity greater than 50.

Tabular grain emulsions are specifically contemplated for at least one layer of the invention elements, such as those disclosed by Wilgus et al U.S. Pat. Nos. 4,434,226; Daubendiek et al 4,414,310; Wey 4,399,215; Solberg et al 4,433,048; Mignot 4,386,156; Evans et al 4,504,570; Maskasky 4,400,463; Wey et al 4,414,306; Maskasky 4,435,501 and 4,643,966; and Daubendiek et al 4,672,027 and 4,693,964. Also specifically contemplated are those silver bromoiodide grains with a higher molar proportion of iodide in the core of the grain than in the periphery of the grain, such as those described in G. B. U.S. Pat. No. 1,027,146; Japanese 54/48521; U.S. Pat. Nos. 4,379,837; 4,444,877; 4,665,012; 4,686,178; 4,565,778; 4,728,602; 4,668,614; 4,636,461; EP 264,954; U.S. Ser. Nos. 842,683 of Antoniades et al filed Feb. 27, 1992, 764,868 filed Sep. 24, 1991, and 826,338 filed Jan. 27, 1992. Also suitable for the invention are tabular silver chloride grains such as disclosed in U.S. Pat. Nos. 5,176,991; 5,176,992; 5,178,998; 5,183,743; and 5,185,239 and European Patent Publication 0 534 395. The silver halide emulsions can be either monodisperse or polydisperse as precipitated. The emulsion grains can feature specified proportions and placements of crystal dislocations as known in the art. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines, and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure,* Item 308119, cited above, Section IV.

The spatially fixed dyes useful in photographic elements are well known in the art. These spatially fixed dyes are also known as non-diffusible dyes and as antihalation dyes. The spatially fixed dyes utilized in the invention include dyes and their preparation and methods of incorporation in photographic materials disclosed in U.S. Pat. Nos. 4,855,220; 4,756,600; and 4,956,269, as well as by commercially available materials. Other examples of spatially fixed dyes suitable for the invention are disclosed at Section VIII of *Research Disclosure,* Item 308119.

The spatially fixed dye selected for the invention absorbs light in the region of the spectrum to which the silver halide layer of the invention is sensitized. While the dye will generally absorb light primarily only in that region, dyes that absorb light in broader areas of the spectrum including the region to which the silver halide is sensitized, are also included within the scope of the invention.

By spatially fixed, it is meant that substantially none of the dye will migrate out of the layer in which it has been incorporated before the photographic material has been processed.

These dyes may be ballasted to render them non-diffusible or they may be intrinsically diffusible but rendered non-diffusible by use of organic mordanting materials, such as charged or uncharged polymeric matrixes, or rendered non-diffusible by adhesion to inorganic solids such as silver halide, or organic solids all as known in the art. Alternatively, these dyes may be incorporated in polymeric latexes. These dyes may additionally be covalently bound to polymeric materials.

These dyes may retain their color after processing or may change in color, be decolorized or partially or completely removed from the photographic material during processing. For ease of direct viewing or optical printing it may be preferred that the dyes be removed from the material or be rendered non-absorbing in the visible region during or after processing. During photographic development (generally in high pH, e.g. 9 or above, sulfite containing processing solution), bleaching (in iron containing or persulfate or other peroxy containing solutions at lower pH, e.g. 7 or below) or fixing, the dye may be decolorized or removed from the material. In photographic elements where the image may be electronically scanned or digitally manipulated, the element may or may not retain some degree of coloration depending on the intended use.

The spatially fixed dye may be a diffusible acidic dye that is rendered non-diffusible by incorporating a base group-containing polymeric mordant for the dye at a specified position in the photographic material. Such dyes preferably have a sulfo- or carboxy-group. Useful dyes can be acidic dyes of the azo type, the triphenylmethane type, the anthroquinone type, the styryl type, the oxanol type, the arylidene type, the merocyanine type, and others known in the art. Polymer mordants are well known in the art and are described, for example, in U.S. Pat. Nos. 2,548,564; 2,675,316; 2,882,156; and 3,706,563 as well as in *Research Disclosure.*

The spatially fixed dye may also be a solid particle dispersion of a loaded polymer latex of a dye that is insoluble at coating pH but soluble at processing pH's as described in U.S. Pat. No. 4,855,221—Factor et al.

Additionally, the dye may be a colored image dye-forming coupler as disclosed in *Research Disclosure,* Item 308119, Section VII. The color of such a dye may be changed during processing. The dye may be a preformed image coupler dye which would generally remain in the element during processing. The dye may also be a spectral sensitizing dye immobilized by adsorption to chemically unsensitized silver halide. Such a dye would generally be removed from the material during the bleaching or fixing step. It is also preferred to use spatial dyes in hues to match printing compatibility.

Examples of preferred spatially fixed dyes include the dye materials described in the photographic examples illustrating the practice of this invention and include the structures shown below.

CM-1
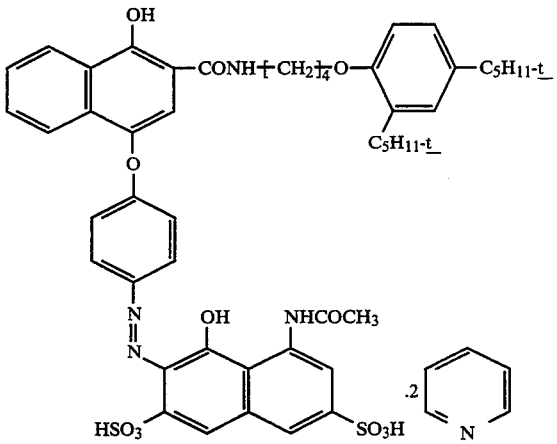
MM-1
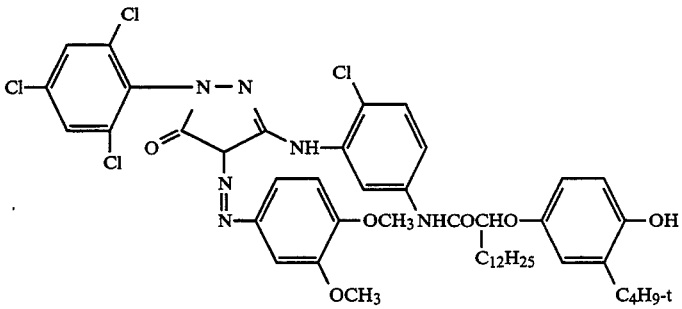
MM-2
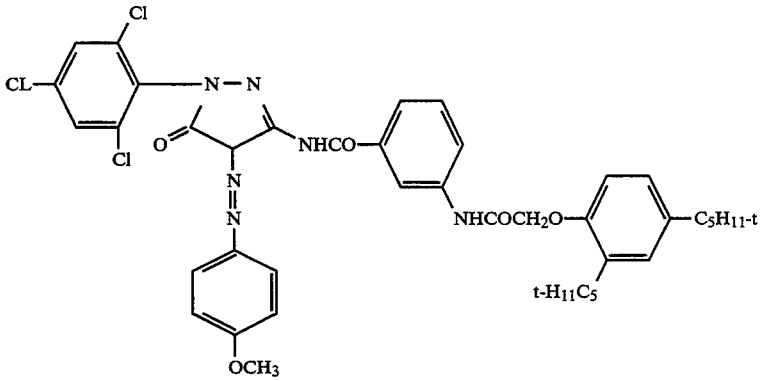
CD-2
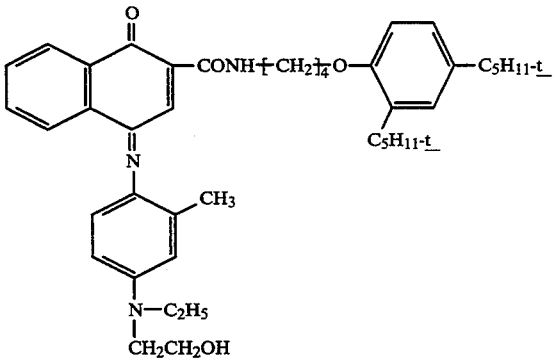

-continued
CD-3
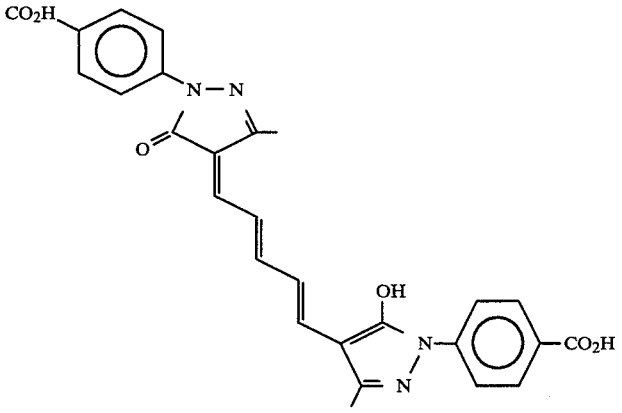
MD-1
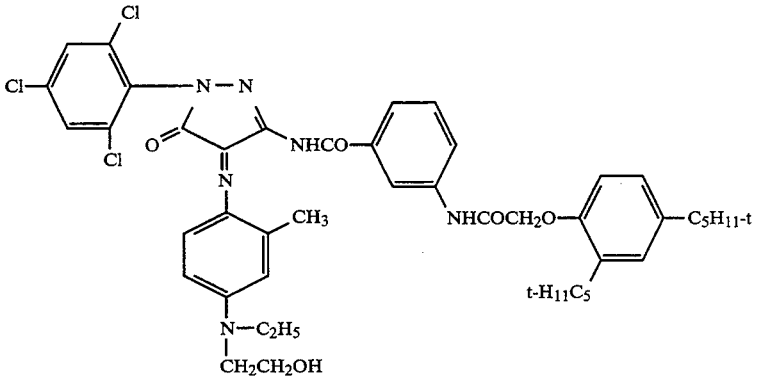
YD-1
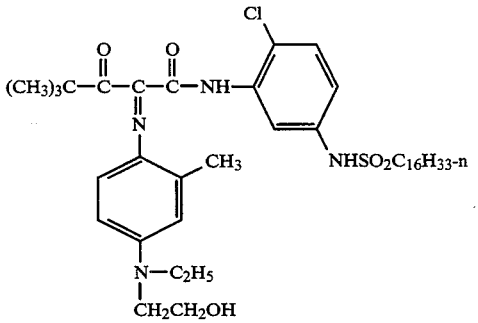
Dye-9
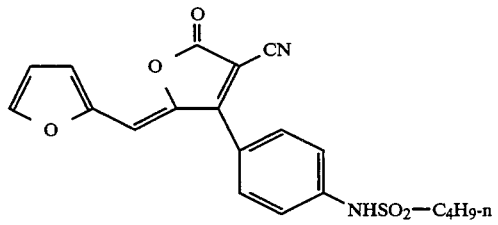
SOL-2
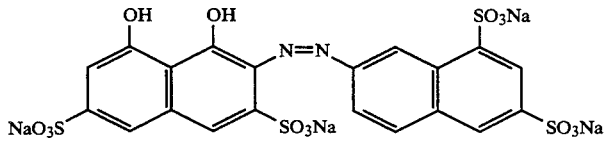

-continued
SOL-1
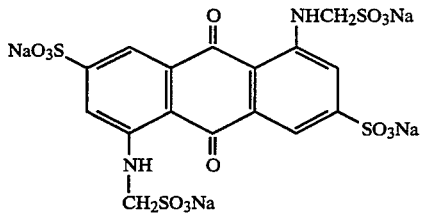
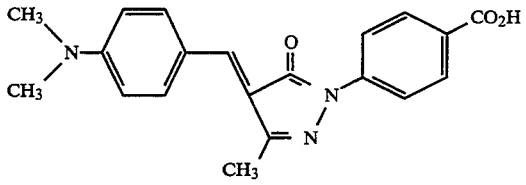
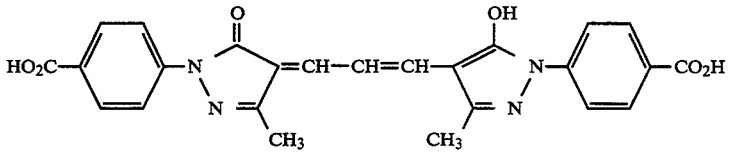
CD-1
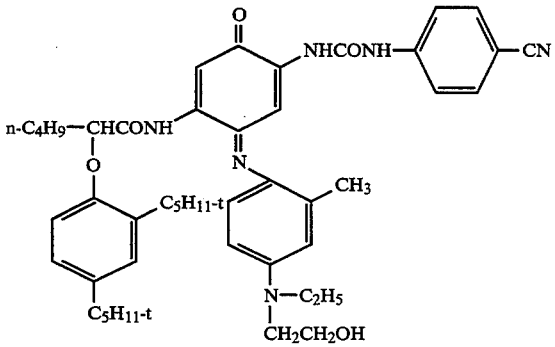
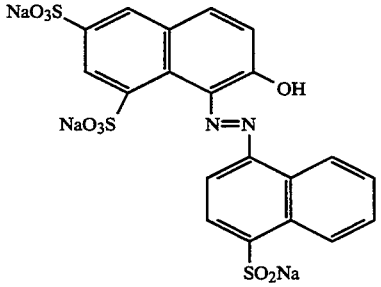
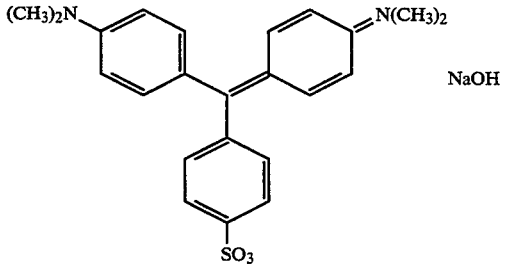
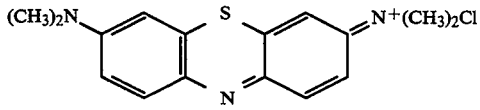

-continued

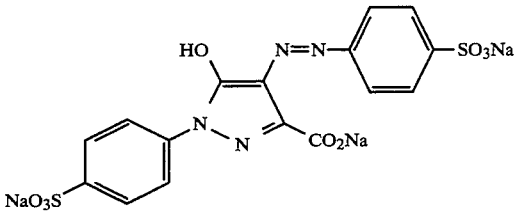

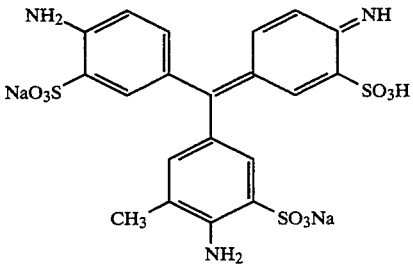

Other useful dye structures include but are not limited to

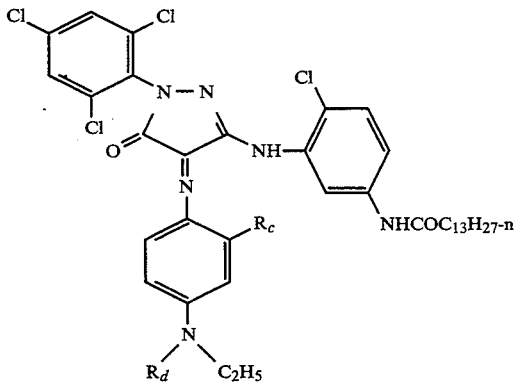

where $R_c$=—H or —$CH_3$and $R_d$=—H; —$CH_2CH_2OH$; —$CH_2CH_3$; or —$CH_2CH_2$—$NHSO_2CH_3$.

Anionic dye structures with one or more sulfonate salt moieties will generally act as distributed dyes except in the presence of a cationic mordant.

Examples of polymer mordants useful in combination with diffusible acidic dyes in elements of the present invention include the following:

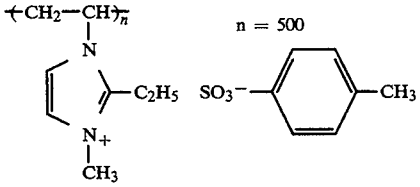

-continued

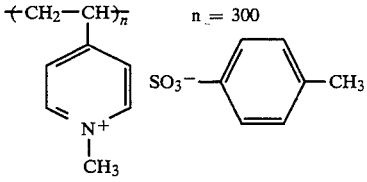

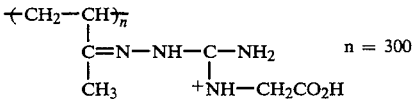

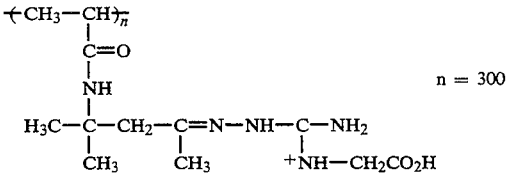

Alternatively, it may be desirable to employ anionically charged polymers in combination with diffusible cationic dyes.

The quantity of spatially fixed dye to be employed is chosen so as to maximize the sharpness gain while minimizing the sensitivity loss. Sensitivity losses of up to 1%, 5%, 20%, 35%, 50%, or more are especially useful. It may further be desirable to additionally locate a spatially fixed dye between an exposure source and the layers of this invention as known in the art.

The distributed dyes useful in combination with the invention spatially fixed dyes typically may be any of the soluble dyes known in the art as disclosed commercially, in U.S. Pat. Nos. 4,855,220; 4,756,600; and 4,956,269, or at Section VIII of *Research Disclosure* cited earlier.

By distributed, it is meant that quantities of the dye (or a dye combination) which absorbs light in the region of the spectrum to which the silver halide layer of the invention is sensitized are present in several of the layers of the photographic material before the exposure of said material.

It is preferred that such distributed dyes be positioned both closer to, coincident with and further from the image exposure source than the photographic layer comprising silver halide emulsion sensitized to a region of the spectrum where such dyes absorb light.

These soluble dyes may be diffusible and have the property of distributing within the structure of a photographic material to a greater or lesser extent during a wet coating procedure or during a subsequent curing or storage procedure. Alternatively, these dyes may be added to a photographic element in a subsequent coating, imbibing or like procedure as known in the art. These soluble dyes may additionally be caused to distribute in specific patterns within a photographic element by the addition of mordanting materials in appropriate quantities and positions within the structure of the photographic element. The mordanting material may be the charged or uncharged polymeric materials described earlier. Alternatively, the distribution of the dye may be controlled by the quantity and disposition of hydrophobic organic materials such as couplers or coupler solvents or absorbent charged or uncharged inorganic materials such as silver halide and the like within the coating structure.

Alternatively, non-diffusible dyes may be employed. These may include any of the non-diffusible dyes previously described. When non-diffusible dyes are employed they may be distributed within a photographic element by addition of a portion of each to the photographic layers as they are coated.

These spatially fixed and, diffusible dyes if present, may retain their color after processing or may change in color, be decolorized or partially or completely removed from the photographic element during processing. For ease of direct viewing or optical printing it may be preferred that the dyes be removed from the film or rendered non-absorbing in the visible region during or after processing. During photographic development (generally in high pH, e.g., 9 or above, sulfite containing processing solution), bleaching (in iron containing or persulfate or other peroxy containing solutions at lower pH, e.g., 7 or below) or fixing, the dye may be decolorized or removed from the element. In photographic elements where the image may be electronically scanned or digitally manipulated, the material may or may not retain some degree of coloration depending on the intended use.

The distributed dye may be a diffusible acidic dye. Such dyes preferably have a sulfo- or carboxy-group. Useful dyes can be acidic dyes of the azo type, the triphenylmethane type, the anthroquinone type, the styryl type, the oxanol type, the arylidene type, the merocyanine type, and others known in the art.

Specific examples of distributed dyes are shown in the literature cited earlier, in the discussion of spatially fixed dyes and in the examples illustrating the practice of the invention.

The thicknesses of the silver halide emulsions employed in this invention may be advantageously adjusted for the purposes of improving film performance according to principles described in *Research Disclosure*, May, 1985, Item 25330. This disclosure teaches, by extrapolation from the optical properties of silver bromide sheet crystals, that the thicknesses of silver halide emulsions incorporated in specific photographic layers and sensitized to one spectral region may be chosen to enable either improved speed or improved sharpness behavior in other photographic layers incorporating silver halide emulsions sensitized to different regions of the spectrum. These improvements are said to occur because the light transmission and reflection properties of the silver halide emulsions are controlled in large part by their grain thicknesses. Further discussion on the relationship between the thickness of silver halide crystals and their reflectance properties can be found in Optics, by J. M. Klein, John Wiley & Sons, New York, 1960, pages 582 to 585.

It is also known that the sharpness of a photographic record can be improved by setting the thickness of the sensitized emulsion utilized in a layer of that record such that the reflection in the region of the spectrum to which that emulsion is sensitized is at a minimum.

Thus, to improve sharpness in a blue sensitized record which incorporates a blue sensitized emulsion with a peak sensitivity at about 450 nm used in a blue sensitive layer, an emulsion grain thickness of between 0.08 and 0.10 microns is preferred. An emulsion grain thickness close to the center of this range, i.e. 0.09 microns is more preferred. An emulsion grain thickness of between 0.19 and 0.21 microns can also be used to advantage in this instance.

In a like manner, to improve sharpness in a green sensitized record which incorporates a green sensitized emulsion with a peak sensitivity at about 550 nm used in a green sensitive layer, an emulsion grain thickness of between 0.11 and 0.13 microns is preferred. An emulsion grain thickness close to the center of this range, i.e. 0.12 microns is more preferred. An emulsion grain thickness of between 0.23 and 0.25 microns can also be used to advantage in this instance.

In a similar vein, to improve sharpness in a red sensitized record which incorporates a red sensitized emulsion with a peak sensitivity at about 650 nm used in a most red sensitive layer, an emulsion grain thickness of between 0.14 and 0.17 microns is preferred. An emulsion grain thickness close to the center of this range, i.e. 0.15 microns is more preferred. An emulsion grain thickness of between 0.28 and 0.30 microns can also be used to advantage in this instance.

It is straightforward to choose emulsion grain thicknesses to improve the sharpness behavior of emulsions sensitized to other regions of the spectrum or with peak sensitivity at different wavelengths according to this invention by following the disclosed pattern.

Thus, for an infrared sensitized emulsion with peak sensitivity at 750 nm, an emulsion grain thickness of between 0.17 and 0.19 microns would be chosen, while for a blue-green sensitized emulsion with peak sensitivity at 500 nm, an emulsion grain thickness of between 0.10 and 0.12 microns would be chosen.

When a photographic record is comprised of more than one photographic layer, it is additionally preferred that the thickness of the silver halide emulsions used in such layers be also chosen so as to minimize reflection in the region of the spectrum to which the emulsion is sensitized.

Even when the thickness of a silver halide emulsion employed in a most sensitive layer is not chosen according to this pattern, it may be useful to choose the thickness of an emulsion used in a less sensitive layer according to the disclosed pattern.

The photographic materials of this invention may advantageously comprise Development Inhibitor Releasing Compounds, also called DIR compounds as known in the art. Typical examples of DIR compounds, their preparation and methods of incorporation in photographic materials are disclosed in U.S. Pat. Nos. 4,855,220 and 4,756,600 as well as by commercially available materials. Other examples of useful DIR compounds are disclosed at Section VIIF of *Research Disclosure.*

These DIR compounds may be incorporated in the same layer as the emulsions of this invention, in reactive association with this layer or in a different layer of the photographic element, all as known in the art.

These DIR compounds may be among those classified as "diffusible," meaning that they enable release of a highly transportable inhibitor moiety or they may be classified as "non-diffusible" meaning that they enable release of a less transportable inhibitor moiety.

The inhibitor moiety of the DIR compound may be unchanged as the result of exposure to photographic processing solution. However, the inhibitor moiety may change in structure and effect in the manner disclosed in U.K. Patent No. 2,099,167; European Patent Application 167,168; Japanese Kokai 205150/83 or U.S. Pat. No. 4,782,012 as the result of photographic processing.

The development inhibitor can be attached to any moiety from which it can be released during the development step. Typically, the compound contains a carrier group from which the accelerator is released either directly or from an intervening timing or linking group which is first released from the carrier group.

Carrier groups useful in DIR compounds include various known groups from which the development inhibitor can be released by a variety of mechanism. Representative carrier groups are described, for example, in U.S. Pat. No. 3,227,550 and Canadian Patent 602,607 (release by chromogentic coupling); U.S. Pat. No. 3,443,939 and 3,443,940 (release by intramolecular ring closure); U.S. Pat. Nos. 3,628,952; 3,698,987; 3,725,062; 3,728,113; 3,844,785; 4,053,312; 4,055,428; and 4,076,529 (release after oxidation of carrier); U.S. Pat. Nos. 3,980,479 and 4,199,335 and U.K. Patents 1,464,104 and 1,464,105 (release unless carrier is oxidized); and U.S. Pat. No. 4,139,379 (release after reduction of carrier).

The timing or linking group of the DIR compound can be any organic linking group which will serve to join the development accelerator moiety to the carrier moiety and which, after its release from the carrier, will be cleaved from the development inhibitor moiety. Such groups are described e.g. in U.S. Pat. Nos. 4,248,962; 4,409,323; and 4,861,701.

When the DIR compound is a developing agent of the type disclosed, for example, at U.S. Pat. No. 3,379,529, the development inhibitor is imagewise released as a result of silver halide development by the developing agent, optionally in the presence of an auxiliary developing agent.

When the DIR compound is a hydroquinone compound of the type described, for example, in European Patent Application 0,167,168, the developement inhibitor is imagewise released by a redox reaction in the presence of an oxidized developing agent.

When the DIR compound is a coupler, the development inhibitor group is imagewise released by a coupling reaction between the coupler and oxidized color developing agent. The carrier moiety can be any coupler moiety employed in conventional color photographic couplers which yields either colored or a colorless reaction product.

Especially preferred are coupler compounds, including both dye forming couplers and so called "universal" couplers which do not form a colored species on reaction with oxidized silver halide developing agent.

When the DIR compounds are dye-forming couplers, they may be incorporated in reactive association with complementary color sensitized silver halide emulsions, as for example a cyan dye-forming DIR coupler with a red sensitized emulsion or in a mixed mode, as for example a yellow dye-forming DIR coupler with a green sensitized emulsion, all as known in the art.

The DIR compounds may also be incorporated in reactive association with bleach accelerator releasing couplers as disclosed in U.S. Pat. Nos. 4,912,024 5,135,839, and in U.S. application Ser. No. 563,725 filed Aug. 8, 1990.

The DIR compounds can be employed at any quantity as known in the art. Typically, quantities of above 0.001 mol % relative to silver are useful. Quantities between 0.01 and 10 mol % are preferred, quantities between 0.05 and 5 mol % are more preferred, and quantities between 0.1 and 3 mol % are most preferred.

Specific DIR compounds useful in the practice of this invention are disclosed in the above-cited references, in commercial use and in the examples demonstrating the practice of this invention which follow. The structures of other useful DIR compounds are shown below.

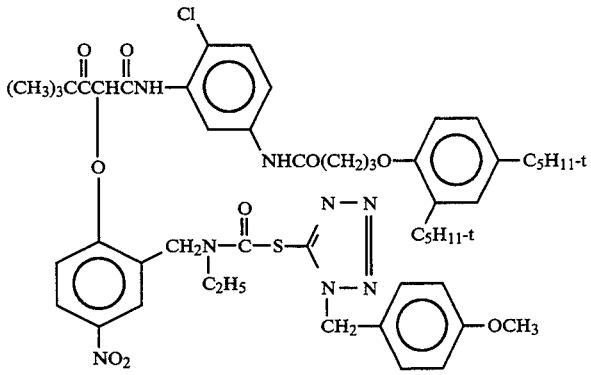

-continued
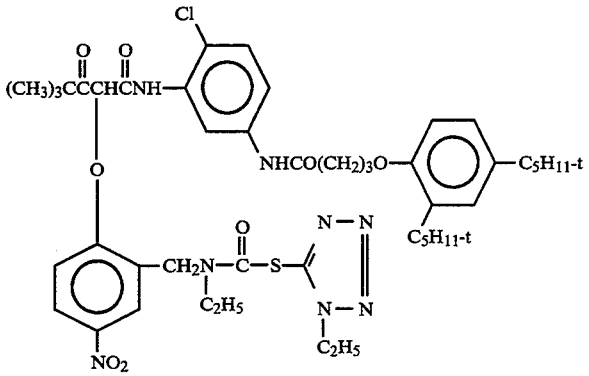
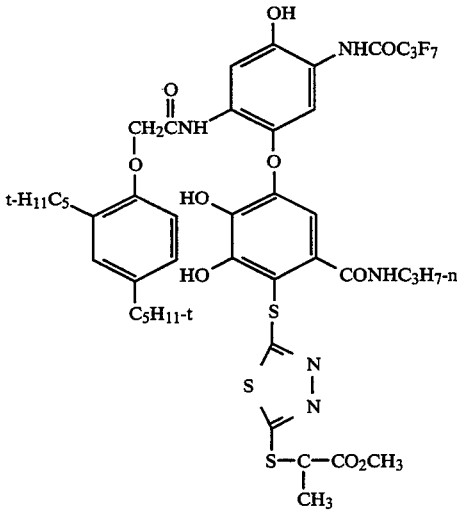
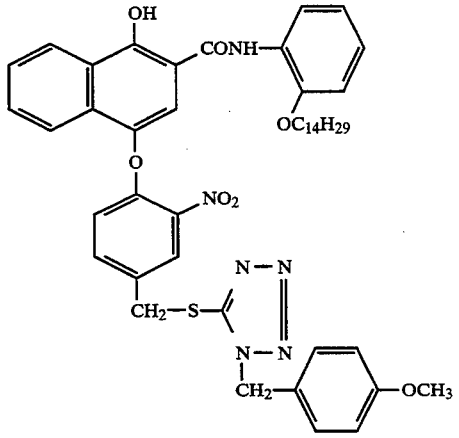
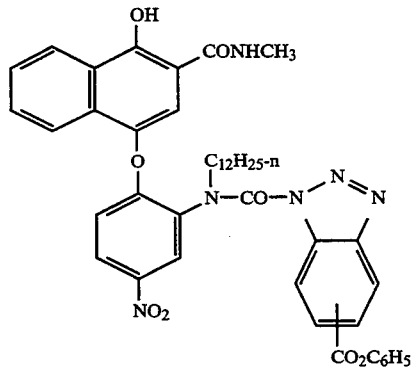

-continued
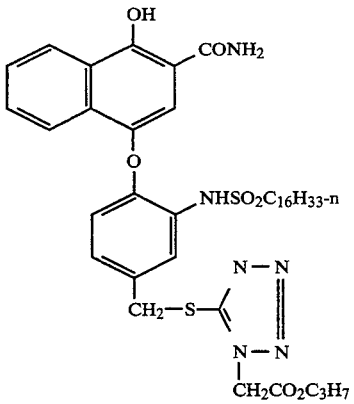
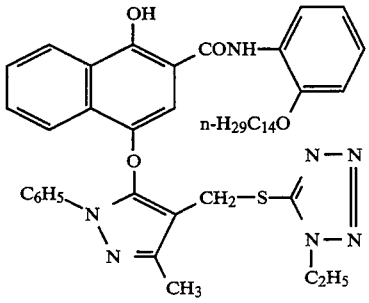
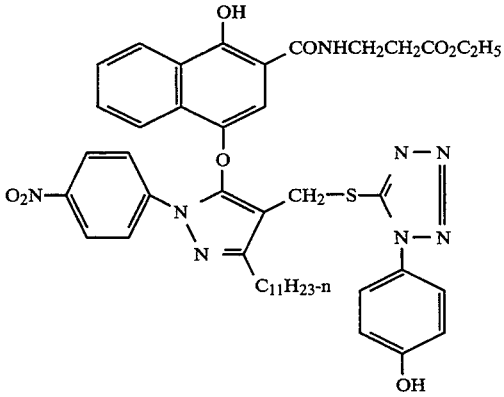
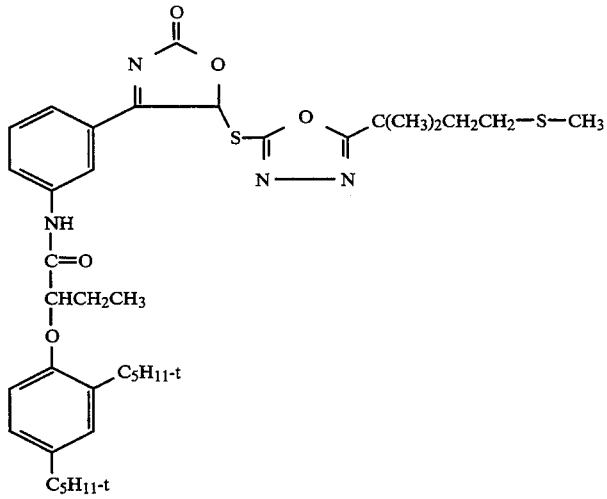

-continued
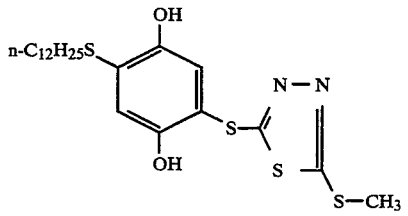
D-1
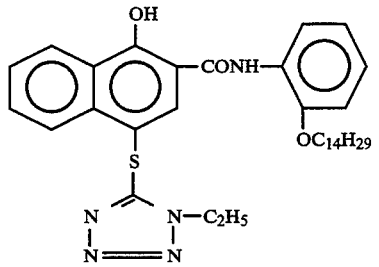
D-2
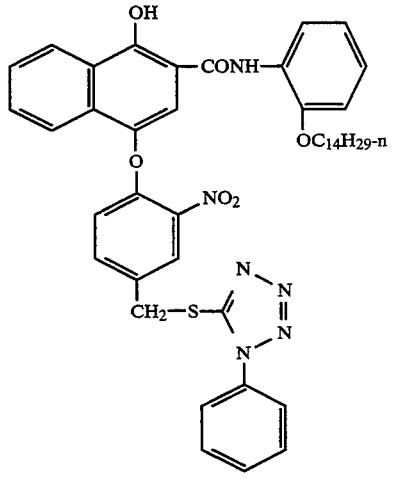
D-3
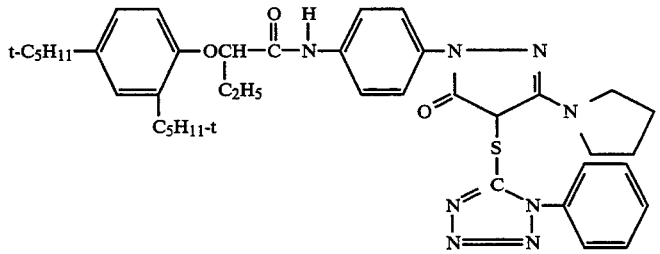
D-4
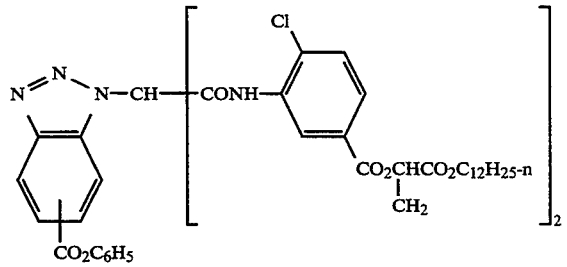

-continued

D-5

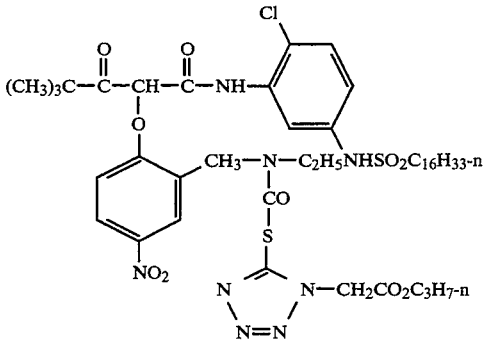

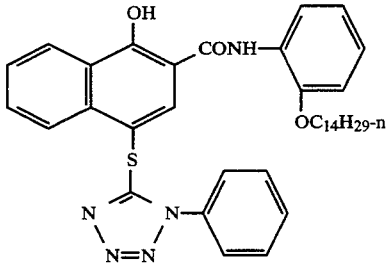

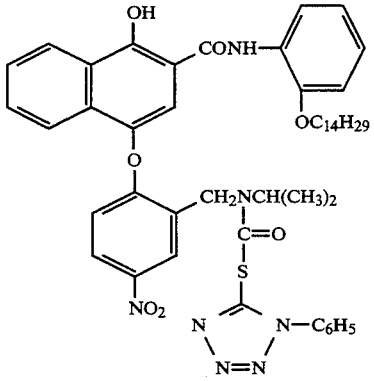

Suitable vehicles for the emulsion layers and other layers of photographic elements of this invention are described in *Research Disclosure* Item 308119, Section IX, and the publications cited therein.

In addition to the couplers described herein, the elements of this invention can include additional couplers as described in *Research Disclosure* Section VII, paragraphs D, E, F, and G, and the publications cited therein. These additional couplers can be incorporated as described in *Research Disclosure* Section VII, paragraph C, and the publications cited therein.

The photographic elements of the invention may also comprise Bleach Accelerator Releasing (BAR) compounds as described in European Patents 0 193 389 B and 0 310 125; and at U.S. Pat. No. 4,842,994, and Bleach Accelerator Releasing Silver Salts as described at U.S. Pat. Nos. 4,865,956 and 4,923,784 hereby incorporated by reference. Typical structures of such useful compounds include:

B-1

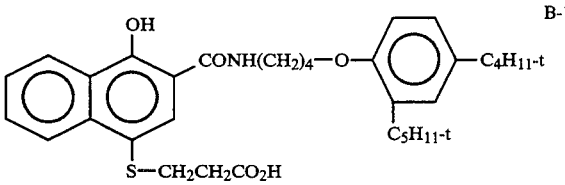

B-2

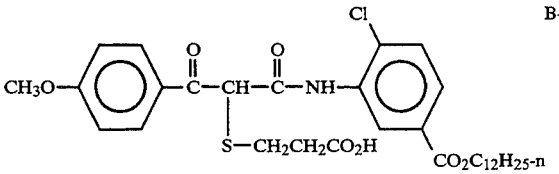

-continued

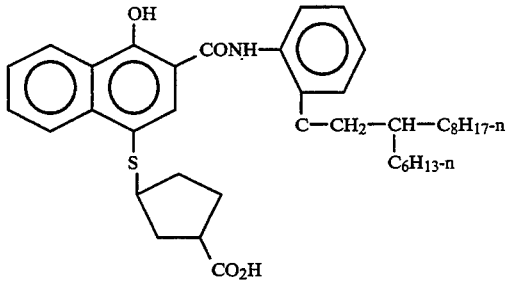

$Ag—S—CH_2CH_2CO_2H$

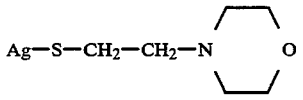

Other useful bleach bleaching and bleach accelerating compounds and solutions are described in the above publications.

The photographic elements of this invention can be used with colored masking couplers as described in U.S. Pat. Nos. 4,883,746 and 4,833,069.

The photographic elements of this invention can contain brighteners (*Research Disclosure* Section V), antifoggants and stabilizers (*Research Disclosure* Section VI), antistain agents and image dye stabilizers (*Research Disclosure Section* VII, paragraphs I and J), light absorbing and scattering materials (*Research Disclosure* Section VIII), hardeners (*Research Disclosure* Section XI), plasticizers and lubricants (*Research Disclosure* Section XII), antistatic agents (*Research Disclosure* Section XIII), matting agents (*Research Disclosure* Section XVI), and development modifiers (*Research Disclosure* Section XXI).

The photographic elements can comprise polymer latexes as described in U.S. patent application Ser. Nos. 720,359 and 720,360 filed Jun. 25, 1991, and 771,016 filed Oct. 1, 1991, and in U.S. Pat. Nos. 3,576,628; 4,247,627; and 4,245,036, the disclosures of which are incorporated by reference.

The photographic elements can be coated on a variety of supports as described in *Research Disclosure* Section XVII and the references described therein. Supports comprising magnetic layers as described in *Research Disclosure*, November, 1992, Item 34390, are particularly contemplated.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the material with a color developing agent to reduce developable silver halide and oxidize the color developing agent. Oxidized color developing agent in turn reacts with the coupler to yield a dye.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing to remove silver and silver halide, washing, and drying.

Typical bleach baths contain an oxidizing agent to convert elemental silver, formed during the development step, to silver halide. Suitable bleaching agents include ferricyanides, dichromates, ferric complexes of aminocarboxylic acids, such as ethylene diamine tetraacetic acid and 1,3-propylene diamine tetraacetic acid as described at *Research Disclosure*, Item No. 24023 of April, 1984. Also useful are peroxy bleaches such as persulfate, peroxide, perborate, and percarbonate. These bleaches may be most advantageously employed by additionally employing a bleach accelerator releasing compound in the film structure. They may also be advantageously employed by contacting the film structure with a bleach accelerator solution during photographic processing. Useful bleach accelerator releasing compounds and bleach accelerator solutions are discussed in European Patents 0 193 389B and 0 310 125A; and in U.S. Pat. Nos. 4,865,956; 4,923,784; and 4,842,994, the disclosures of which are incorporated by reference.

Fixing baths contain a complexing agent that will solubilize the silver halide in the element and permit its removal from the element. Typical fixing agents include thiosulfates, bisulfites, and ethylenediamine tetraacetic acid. Sodium salts of these fixing agents are especially useful. These and other useful fixing agents are described in U.S. Pat. No. 5,183,727. Use of a peracid bleach bath and a subsequent low ammonium, thiosulfate fixing bath are especially preferred.

In some cases the bleaching and fixing baths are combined in a bleach/fix bath.

The following examples illustrate the practice of this invention. They are not intended to be exhaustive of all possible variations of the invention. Parts and percentages are by weight unless otherwise indicated.

PREPARATIVE PHOTOGRAPHIC EXAMPLE 1

A color photographic recording material (Photographic Sample 101) for color negative development was prepared by applying the following layers in the given sequence to a transparent support of cellulose triacetate. The quantities of silver halide are given in g of silver per $m^2$. The quantities of other materials are given in g per $m^2$. All silver halide emulsions were stabilized with 2 grams of 4-hydroxy-6-methyl-1,3,3*a*,7-tetraazaindene per mole of silver.

Layer 1 {Antihalation Layer} black colloidal silver sol containing 0.236 g of silver, with 2.44 g gelatin.

Layer 2 {Least Red-Sensitive Layer} Emulsion ER-1 at 0.70 g, Emulsion ER-2 at 0.59 g, cyan dye-forming image coupler C-1 at 0.86 g, DIR compound D-1 at 0.043 g, DIR compound D-2 at 0.011 g BAR compound B-1 at 0.043 g, cyan dye-forming masking coupler CM-1 at 0.065 g, scavenger S-1 at 0.011 g with gelatin at 2.21 g.

Layer 3 {omitted}

Layer 4 {Most Red-Sensitive Layer} Emulsion ER-3 at 0.60 g, cyan dye-forming image coupler C-1 at 0.086 g, DIR compound D-1 at 0.023 g, DIR compound D-2 at 0.016 g, cyan dye-forming masking coupler CM-1 at 0.043 g, scavenger S-1 at 0.011 g with gelatin at 1.72 g.

followed by:

a gelatin interlayer comprising an oxidized developer scavenger;

a green light sensitive magenta dye forming color record comprising gelatin, green light sensitized silver halide emulsions EG-1 at 0.70 g, EG-2 at 0.65 g and EG-3 at 0.54 g with magenta dye forming couplers M-1 at 0.38 g, and M-2 at 0.22 g, DIR compounds D-3 at 0.022 g and D-4 at 0.043 g, magenta dye-forming masking coupler MM-1 at 0.065 g and scavenger S-1 at 0.011 g;

a gelatin interlayer comprising an oxidized developer scavenger and a yellow light filter;

a blue light sensitive yellow dye-forming color record comprising gelatin, blue light sensitized silver halide emulsions EB-1 at 0.48 g, EB-2 at 0.38 g and EB-3 at 0.43 g, yellow dye forming image coupler Y-1 at 1.08 g, DIR compound D-5 at 0.11 g, and BAR compound B-1 at 0.005 g;

Protective overcoat layers comprising gelatin dye UV-1, dye UV-2, unsensitized silver bromide Lippman emulsion, anti-matte beads and so forth.

This film was hardened at coating with 2% by weight to total gelatin of hardner H-1. Surfactants, coating aids, scavengers, dyes and stabilizers were added to the various layers of this sample as is commonly practiced in the art. Photographic sample 101 showed an imaging layer thickness of about 16 microns and a total thickness of about 21 microns.

Photographic Sample 102 was like Photographic Sample 101 except that 1.72 g of gelatin was included in layer 3 and 0.075 g of cyan dye CD-1 was added to layer 3. Cyan dye CD-1 is a ballasted, spatially fixed red light absorbing material that substantially maintains it's density after photographic processing. Emulsion ER-2 in layer 2 was replaced by an equal quantity of emulsion ER-3.

Photographic Sample 103 was like Photographic Sample 101 except that 0.075 g of cyan dye CD-1 was added to layer 2, and emulsion ER-2 was replaced by an equal quantity of emulsion ER-3.

Photographic Sample 104 was like Photographic Sample 101 except that layers 2 and 3 were modified so as to comprise:

in Layer 2 {Least Red-Sensitive Layer} Emulsion ER-1 at 0.70 g, g, cyan dye-forming image coupler C-1 at 0.75 g, DIR compound D-1 at 0.022 g, DIR compound D-2 at 0.011 g BAR compound B-1 at 0.043 g, cyan dye-forming masking coupler CM-1 at 0.032 g, scavenger S-1 at 0.011 g with gelatin at 2.21 g; and in Layer 3 {More Red-Sensitive Layer} Emulsion ER-3 at 0.59 g, cyan dye-forming image coupler C-1 at 0.097 g, DIR compound D-1 at 0.023 g, DIR compound D-2 at 0.005 g, cyan dye-forming masking coupler CM-1 at 0.032 g, scavenger S-1 at 0.011 g, and cyan dye CD-1 at 0.0755 g with gelatin at 1.72 g;

Layer 4 remained unchanged.

Photographic Sample 105 was like Photographic Sample 101 except that emulsions ER-1 and ER-2 in layer 2 were replaced by equal quantities of emulsions ER-11 and ER-21 respectively, and emulsion ER-3 in layer 4 was replaced by an equal quantity of emulsion ER-31.

Photographic Sample 106 was like Photographic Sample 105 except that 0.075 g of cyan dye SOL-1 was added to the red sensitive emulsion layers. Cyan dye SOL-1 is a soluble red light absorbing dye that distributes in the element structure and is removed during photographic processing to leave substantially no density in the element.

Photographic Sample 107 was like Photographic Sample 102 except that emulsions ER-1 and ER-3 were replaced by equal quantities of emulsions ER-11 and ER-31 respectively.

Photographic Sample 108 was like Photographic Sample 103 except that emulsions ER-1 and ER-3 were replaced by equal quantities of emulsions ER-11 and ER-31 respectively.

Photographic Sample 109 was like Photographic Sample 108 except that cyan dye CD-1 was replaced by an equal quantity of blue dye CD-3 in layer 2. Blue dye CD-3 is supplied as a solid particle dye dispersion. As such, it is a spatially fixed red (and green) light absorbing dye that remains localized in the layer in which it is coated and is removed during photographic processing to leave behind substantially no red density.

Photographic Sample 110 was like Photographic Sample 101 except that layers 2, 3 and 4 were modified so as to comprise:

in Layer 2 {Least Red-Sensitive Layer} Emulsion ER-11 at 0.70 g, g, cyan dye-forming image coupler C-1 at 0.75 g, DIR compound D-1 at 0.022 g, DIR compound D-2 at 0.011 g BAR compound B-1 at 0.043 g, cyan dye-forming masking coupler CM-1 at 0.032 g, scavenger S-1 at 0.011 g with gelatin at 2.21 g;

in Layer 3 {More Red-Sensitive Layer} Emulsion ER-21 at 0.59 g, cyan dye-forming image coupler C-1 at 0.097 g, DIR compound D-1 at 0.023 g, DIR compound D-2 at 0.005 g, cyan dye-forming masking coupler CM-1 at 0.032 g, scavenger S-1 at 0.011 g, and cyan dye CD-1 at 0.0755 g with gelatin at 1.72 g;

in Layer 4 {Most Red-Sensitive Layer}Emulsion ER-31 at 0.60 g, cyan dye-forming image coupler C-1 at 0.086 g, DIR compound D-1 at 0.023 g, DIR compound D-2 at 0.016 g, cyan dye-forming masking coupler CM-1 at 0.043 g, scavenger S-1 at 0.011 g with gelatin at 1.72 g; and and 0.075 g of ballasted and spatially fixed cyan dye CD-1 was added to the sample in a layer closer to the exposure source than any red light sensitive layer.

Photographic Sample 111 was like Photographic Sample 110 except that cyan dye CD-1 was replaced by an equal quantity of blue dye CD-3, the spatially fixed but removable red light absorber dye.

Photographic Sample 112 was like Photographic Sample 110 except that dye CD-1 was replaced by an equal quantity of soluble cyan dye SOL-1 in the emulsion layers.

Photographic Sample 113 was like Photographic Sample 104 except that emulsions ER-1 and ER-3 were replaced by equal quantities of emulsions ER-11 and ER-31, and dye CD-1 was replaced by dye CD-3.

Photographic Sample 114 was like Photographic Sample 113 except that emulsion ER-11 was replaced by emulsion ER-21 in layer 2 and dye CD-1 was employed instead of dye CD-3 in layer 3.

Photographic Sample 115 was like Photographic Sample 114 except that emulsion ER-31 in layer 3 was replaced by an equal quantity of emulsion ER-21, cyan dye CD-1 was omitted from layer 3 and an equal quantity of blue dye CD-3 was instead added to layer 2.

The light sensitive silver halide emulsions employed in photographic samples 101 through 115 showed grain dimensions in microns and halide content as listed below. ECD is average equivalent circular diameter while thick is average grain thickness.

ER-1: 0.27 ECD×0.09 thick silver iodobromide, 4.8 mol percent iodide;

ER-2: 0.56 ECD×0.19 thick silver iodobromide, 12 mol percent iodide;

ER-3: 1.05 ECD×0.35 thick silver iodobromide, 9 mol percent iodide;

ER-11: 0.55 ECD×0.087 thick silver iodobromide, 1.5 mol percent iodide;

ER-21: 1.05 ECD×0.09 thick silver iodobromide, 4 mol percent iodide;

ER-31: 1.31 ECD×0.12 thick silver iodobromide, 4 mol percent iodide.

EG-1: 0.52 ECD×0.087 thick silver iodobromide, 4 mol percent iodide;

EG-2: 1.06 ECD×0.09 thick silver iodobromide, 4 mol percent iodide;

EG-3: 1.29 ECD×0.12 thick silver iodobromide, 4 mol percent iodide;

EB-1: 0.53 ECD×0.086 thick silver iodobromide, 1.3 mol percent iodide;

EB-2: 0.71 ECD×0.087 thick silver iodobromide, 4 mol percent iodide;

ER-3: 0.93 ECD×0.23 thick silver iodobromide, 6 mol percent iodide.

ILLUSTRATIVE PHOTOGRAPHIC EXAMPLE 2

Photographic Samples 101 through 115 were exposed using white light to sinusoidal patterns to determine the Modulation Transfer Function (MTF) Percent Response as a function of spatial frequency in the film plane. Specific details of this exposure—evaluation cycle can be found at R. L. Lamberts and F. C. Eisen, "A System for the Automated Evaluation of Modulation Transfer Functions of Photographic Materials", in the Journal of Applied Photographic Engineering, Vol. 6, pages 1–8, February 1980. A more general description of the determination and meaning of MTF Percent Response curves can be found in the articles cited within this reference. The exposed samples were developed and bleached according to the C-41 Process as described in the British Journal of Photography Annual for 1988 at pages 196–198. The bleach solution was modified so as to additionally comprise 1,3-propylene diamine tetraacetic acid. The exposed and processed samples were evaluated to determine the MTF Percent Response of the red density record as a function of spatial frequency in the film plane as described above. The MTF Percent Response thus determined was evaluated for its impact on the sharpness of a viewed image by determining the acutance available from each following the procedures described by R. G. Gendron, "An Improved Objective Method for Rating Picture Sharpness", in the Journal of the Society of Motion Picture and Television Engineers, Vol. 82, page 1009 (1973). Acutance values assuming a 3.8× enlargement and a 21× enlargement were determined. Larger values of MTF Percent Response translate into larger values of acutance. The acutance scale is designed so that a change on one acutance unit corresponds to a difference in the visual appearance of sharpness apparent to one-half of all viewers. The samples were additionally exposed to white light through a graduated density test object and processed as described above. The Status M red density produced was evaluated for each sample so as to determine the relative photographic sensitivity or speed of each sample. The change in red record sensitivity and red record acutance for the two enlargement conditions are listed in Table 1, below.

TABLE 1

Red color sensitivity and acutance for photographic samples 101 through 115

| | Emulsion and Dye Positions | | | Exposure | Relative | Relative Acutance | |
|---|---|---|---|---|---|---|---|
| Sample | Layer 2 | Layer 3 | Layer 4 | Source | Sensitivity | 3.8x | 21x |
| 101 | X | omit | X | <-- | 100% | check | check |
| 102 | X | CD-1 | X | <-- | 63% | +1.5 | +1.7 |
| 103 (inv) | X + CD-1 | omit | X | <-- | 83% | +1.3 | +2.5 |
| 104 (inv) | X | X + CD-1 | X | <-- | 91% | +1.2 | +1.0 |
| 105 | X | omit | X | <-- | 100% | = check | = check |
| 106 | X + SOL-1 | omit | X + SOL-1 | <-- | 23% | +1.6 | +3.1 |
| 107 | X | CD-1 | X | <-- | 71% | +1.0 | +0.9 |
| 108 (inv) | X + CD-1 | omit | X | <-- | 89% | +0.8 | +1.9 |
| 109 (inv) | X + CD-3 | omit | X | <-- | 71% | +1.9 | +3.3 |
| 110 | X | X | X | CD-1 <- | 39% | +2.1 | +3.0 |
| 111 | X | X | X | CD-3 <- | 23% | +3.0 | +3.9 |
| 112 | X + SOL-1 | X + SOL-1 | X + SOL-1 | <-- | 32% | +3.9 | +4.7 |
| 113 (inv) | X | X + CD-3 | X | <-- | 63% | +3.6 | +5.3 |
| 114 (inv) | X | X + CD-1 | X | <-- | 74% | +2.6 | +3.8 |
| 115 (inv) | X + CD-3 | X | X | <-- | 78% | +2.5 | +3.4 |

* X indicates the presence of a sensitized emulsion in the layer.
* Samples 101 through 104 employ emulsions with a highest aspect ratio of 3:1, while Samples 105 through 115 employ emulsions with a highest aspect ratio of 12:1 in the color record affected by the presence of the added absorber dye.
* Samples 101 and 105 are baseline controls.
* The spatial relationship of sensitized emulsion placement, absorber dye placement and exposure source in samples 102 and 107 are like those described in U.S. Pat. Nos. 3,450,536; 3,663,228; 3,812,507 and 3,849,138.
* The spatial relationship of sensitized emulsion placement, absorber dye placement and exposure source in samples 110 and 111 are like those described in U.S. Pat. Nos. 4,746,600 and 4,855,220 as well as co-pending USSN 869,987.
* The spatial relationship of sensitized emulsion placement, absorber dye placement and exposure source in samples 106 and 112 are like those described in U.S. Pat. Nos. 4,956,269 and co-pending USSN 869,675.

As is readily apparent on examination of the results disclosed in Table 1, samples 103, 104, 108, 109, 113, 114 and 115 according to the current invention simultaneously exhibit both superior degrees of sharpness and greater sensitivity than do samples prepared according to closely related prior art.

Figure 2:
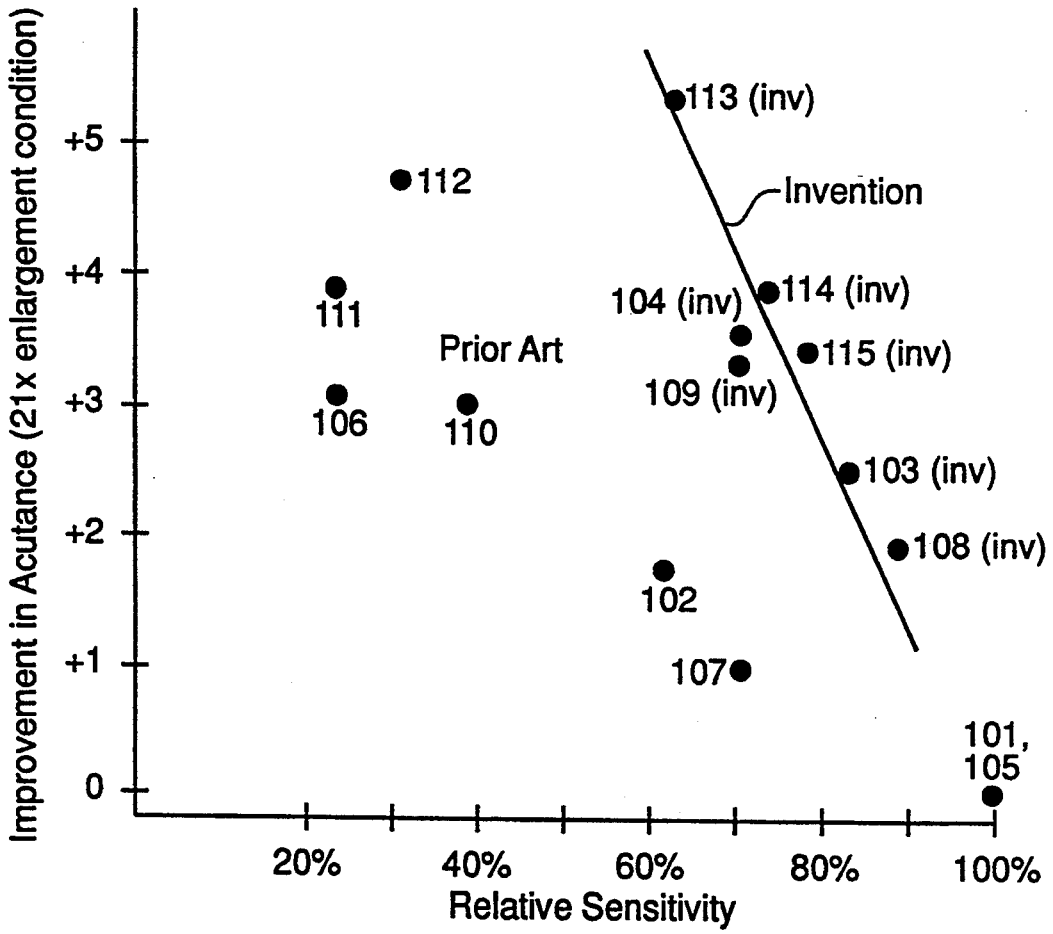

FIGS. 1 and 2 display this same data graphically and serve to illustrated that samples according to the present invention exhibit surprisingly large degrees of sharpness improvement when compared to the various layer and component arrangements previously known.

PREPARATIVE PHOTOGRAPHIC EXAMPLE 3

A color photographic recording material (Photographic Sample 201) for color development was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents, surfactants and stabilizers or as solutions as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxaxole and so forth. The silver halide emulsions were stabilized with 2 grams of 4-hydroxy-6-methyl-l,3,3a,7-tetraazaindene per mole of silver.

Layer 1 {Antihalation Layer}: MD-1 at 0.011 g; MM-2 at 0.065 g; CD-3 at 0.108 g; UV-1 at 0.075g; gray colloidal silver at 0.215 g; SOL-1 at 0.005; SOL-2 at 0.005 g; CD-1 at 0.129 g with 2.41 g gelatin.

Layer 2 {Interlayer}: 0.108 g of S-1; with 1.08 g of gelatin.

Layer 3 {Lowest Sensitivity Red-Sensitive Layer}: Red sensitive silver iodobromide emulsion, ca. 4 mole percent iodide, average equivalent circular diameter 0.5 microns, average thickness 0.08 microns at 0.538 g; C-1 at 0.753 g; D-1 at 0.022g; CM-1 at 0.054 g; B-1 at 0.043 g; S-1 at 0.005 g; with gelatin at 1.72 g.

Layer 4 {Medium Sensitivity Red-Sensitive Layer}: Red sensitive silver iodobromide emulsion, ca. 3.7 mole percent iodide, average equivalent circular diameter 1.0 microns, average grain thickness 0.09 microns at 0.592 g; C-1 at 0.097 g; D-1 at 0.022 g; CM-1 at 0.032 g; D-2 at 0.005 g; S-1 at 0.005 g; with gelatin at 1.72 g.

Layer 5 {Highest Sensitivity Red-Sensitive Layer}: Red sensitive silver iodobromide emulsion, ca. 3.7 mole percent iodide, average equivalent circular diameter 1.2 microns, average grain thickness 0.13 microns at 0.592 g; C-1 at 0.086 g; D-1 at 0.022 g; CM-1 at 0.022 g; D-2 at 0.016 g; S-1 at 0.005 g; with gelatin at 1.72 g.

Layer 6 {Interlayer}: S-2 at 0.054 g with 1.29 g of gelatin.

Layer 7 {Lowest Sensitivity Green-Sensitive Layer}: Green sensitive silver iodobromide emulsion, ca. 4 mole percent iodide, average equivalent circular diameter 0.57 microns, average grain thickness 0.14 microns at 0.603 g; M-1 at 0.355 g; D-2 at 0.011 g; MM-1 at 0.043 g; S-1 at 0.005 g; with gelatin at 1.4 g.

Layer 8 {Medium Sensitivity Green-Sensitive Layer}: Green sensitive silver iodobromide emulsion, ca. 3.7 mole percent iodide, average equivalent circular diameter 0.85 microns, average grain thickness 0.12 microns at 0.592 g; M-1 at 0.086 g; D-2 at 0.016 g; MM-1 at 0.038 g; S-1 at 0.005 g; with gelatin at 1.4 g.

Layer 9 {Highest Sensitivity Green-Sensitive Layer}: Green sensitive silver iodobromide emulsion, average equivalent circular diameter 1.05 microns, average grain thickness 0.12 microns at 0.592 g; M-1 at 0.086 g; D-3 at 0.005 g; MM-1 at 0.038 g; S-1 at 0.005 g with gelatin at 1.72 g.

Layer 10 {Interlayer}: S-2 at 0.054 g; DYE-9 at 0.108 g; with 1.29 g of gelatin.

Layer 11 {Lowest Sensitivity Blue-Sensitive Layer}: Blue sensitive silver iodobromide emulsion, ca. 4 mole percent iodide, average equivalent circular diameter 0.5 microns, average grain thickness 0.08 at 0.172 g; Blue sensitive silver iodobromide emulsion, ca. 3.7 mole percent iodide, average equivalent circular diameter 0.70 microns, average grain thickness 0.09 microns at 0.172 g; Y-1 at 1.08 g; D-5 at 0.065 g; B-1 at 0.005 g; S-1 at 0.011 g with gelatin at 1.08 g.

Layer 12 {Highest Sensitivity Blue-Sensitive Layer}: Blue sensitive silver iodobromide emulsion, ca. 3 mole percent iodide, average equivalent circular diameter 0.8 microns, average grain thickness 0.08 microns at 0.43 g; Y-1 at 0.129 g; D-5 at 0.043 g; B-1 at 0.005 g; S-1 at 0.011 g; with gelatin at 1.13 g.

Layer 13 {Protective Layer-1}: UV-1 at 0.108 g; UV-2 at 0.118 g; unsensitized silver bromide Lippman emulsion at 0.108 g; N,N,N,-trimethyl-N-(2-perfluoro-octylsulfonamido-ethyl) ammonium iodide; sodium tri-isopropylnaphthalene sulfonate; SOL-1 at 0.0043 g; CD-1 at 0.006 g; and gelatin at 1.08 g.

Layer 14 {Protective Layer-2}: Silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 0.91 g.

This film was hardened at coating with 2% by weight to total gelatin of hardner H-1. Surfactants, coating aids, scavengers, soluble absorber dyes and stabilizers were added to the various layers of this sample as is commonly practiced in the art. The total dry thickness of the light sensitive layers was about 15.1 microns while the total thickness of all the applied layers was about 23.1 microns.

Photographic Sample 202 was like Photographic Sample 201 except that a) cyan dye CD-1 was omitted from layer 1 and instead placed in layer 4, and b) the emulsion employed in layer 4 was omitted and replaced by an equal quantity of the emulsion employed in layer 5.

Photographic Sample 203 was like photographic sample 202 except that a) image dye forming coupler C-1 was omitted from layers 4 and 5 and replaced by equimolar quantities of cyan dye-forming image coupler C-2, and b) the quantity of D-2 in layers 4 and 5 was adjusted to 0.0097 g and 0.027 g respectively.

ILLUSTRATIVE PHOTOGRAPHIC EXAMPLE 4

Photographic Samples 201 through 203 were evaluated in a manner analogous to that described in Photographic Example 2 above. Results are shown in Table 2 immediately below.

TABLE 2

Red color record sensitivity, acutance, and MTF Percent Response for photographic samples 201 through 203

| Sample | Relative Sensitivity | Relative Acutance 3.8x | Relative Acutance 21x | MTF Percent Response 2.5 c/mm | MTF Percent Response 5 c/mm | MTF Percent Response 50 c/mm | MTF Percent Response 80 c/mm |
|---|---|---|---|---|---|---|---|
| 201 | 100% | check | check | 109% | 111% | 38% | 19% |
| 202 (inv) | 83% | +1.3 | +4.1 | 112% | 113% | 58% | 33% |
| 203 (inv) | 90% | +1.6 | +4.1 | 113% | 115% | 57% | 30% |

Again, the inventive samples provide a high degree of sharpness enhancement with a minimum of sensitivity loss.

ILLUSTRATIVE PHOTOGRAPHIC EXAMPLE 5

Photographic Samples 201 through 203 were evaluated in a manner analogous to that described in Photographic Example 2 above, except that a color reversal process, the E-6 Color Reversal Process as described at the British Journal of Photography Annual for 1982 at pages 201–203 was employed. This is like the color reversal process described at U.S. Pat. No. 4,956,269 starting at column 66, line 46. Results are shown in Table 3 immediately below.

TABLE 3

Red color record sensitivity and MU Percent Response for photographic samples 201 through 203 after a color reversal process

| Sample | Relative Acutance 3.8x | Relative Acutance 21x | MTF Percent Response 2.5 c/mm | MTF Percent Response 5 c/mm | MTF Percent Response 50 c/mm | MTF Percent Response 80 c/mm |
|---|---|---|---|---|---|---|
| 201 | check | check | 99% | 91% | 16% | 7% |
| 202 (inv) | +0.3 | +2.3 | 98% | 92% | 20% | 9% |
| 203 (inv) | +1.0 | +2.6 | 101% | 93% | 21% | 9% |

It is readily apparent that the inventive compositions enable improved sharpness after color reversal processing. Cross comparison of the data presented in examples 4 and 5 further illustrates that the inventive samples show comparatively larger improvements in sharpness with relatively smaller sensitivity losses when a color negative process is employed.

PREPARATIVE PHOTOGRAPHIC EXAMPLE 6

A color photographic recording material (Photographic Sample 301) for color development was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents, surfactants and stabilizers or as solutions as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxaxole and so forth. The silver halide emulsions were stabilized with 2 grams of 4-hydroxy-6-methyl-l,3,3a,7-tetraazaindene per mole of silver.

Layer 1 {Antihalation Layer}: Blue dye CD-3 at 0.165 g; UV-1 at 0.075g; with 2.41 g gelatin.

Layer 2 {Less Red-Sensitive Layer}: Red sensitive silver halide emulsions ER-1 at 0.27 g and ER-2 at 0.38 g; C-1 at 0.86 g; D-1 at 0.044 g; B-1 at 0.011 g; D-2 at 0.022 g; S-1 at 0.005 g; with gelatin at 2.04 g.

Layer 3 {More Red-Sensitive Layer}: Red sensitive silver halide emulsion ER-3 at 0.48 g; C-1 at 0.087 g; D-1 at 0.022 g; D-2 at 0.005 g; S-1 at 0.01 g with gelatin at 0.97 g.

Layer 4 {Interlayer}: S-2 at 0.054 g with 0.91 g of gelatin.

Layer 5 {Lowest Sensitivity Green-Sensitive Layer}: Green sensitive silver halide emulsion EG-1 at 0.269 g; M-1 at 0.16 g; D-3 at 0.011 g; MM-1 at 0.022 g; S-1 at 0.005 g with gelatin at 0.91 g.

Layer 6 {Medium Sensitivity Green-Sensitive Layer}: Green sensitive silver halide emulsion EG-2 at 0.38 g; M-1 at 0.16 g; D-3 at 0.011 g; MM-1 at 0.038 g with gelatin at 1.74 g.

Layer 7 {Highest Sensitivity Green-Sensitive Layer}: Green sensitive silver halide emulsion EG-3 at 0.43 g; M-1 at 0.18 g; M-2 at 0.11 g; D-5 at 0.004 g; MM-1 at 0.033 g; S-1 at 0.005 g; with gelatin at 1.26 g.

Layer 8 {Interlayer}: S-2 at 0.054 g; yellow filter DYE9 at 0.108 g with 0.65 g of gelatin.

Layer 9 {Blue-Sensitive Layer}: Blue sensitive silver halide emulsions EB-1 at 0.30 g, EB-2 at 0.19 g, and EB-3 at 0.24 g; Y-1 at 1.08 g; D-5 at 0.065 g; B-1 at 0.005 g; S-1 at 0.011 g with gelatin at 2.15 g.

Layer 10 {Protective Layer}: UV-1 at 0.108 g; UV-2 at 0.118 g; unsensitized silver bromide Lippman emulsion at 0.108 g; N,N,N,-trimethyl-N-(2-perfluoro-octylsulfonamido-ethyl) ammonium iodide; sodium tri-isopropylnaphthalene sulfonate; silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g and gelatin at 2.15 g.

This film was hardened at coating with 2% by weight to total gelatin of hardner H-1. Surfactants, coating aids, scavengers, soluble absorber dyes and stabilizers were added to the various layers of this sample as is commonly practiced in the art. The total dry thickness of the light sensitive layers was about 13.4 microns while the total thickness of all the applied layers was about 19.6 microns.

Photographic Sample 302 was like Photographic Sample 301 except that blue dye CD-3 was added to layer 5 at 0.075 g and emulsion EG-1 in layer 5 was replaced by an equal quantity of emulsion EG-2.

Photographic Sample 303 was like Photographic Sample 301 except that blue dye CD-3 was added to layer 6 at 0.075 g and emulsion EG-2 in layer 6 was replaced by an equal quantity of emulsion EG-3.

ILLUSTRATIVE PHOTOGRAPHIC EXAMPLE 7 the green light sensitive color record was monitored. Results are shown in Table 4 immediately below.

TABLE 4

Green color record sensitivity, acutance, and MTF Percent Response for photographic samples 301 through 303

| Sample | Relative Sensitivity | Relative Acutance 3.8x | Relative Acutance 21x | MTF Percent Response 2.5 c/mm | MTF Percent Response 5 c/mm | MTF Percent Response 50 c/mm | MTF Percent Response 80 c/mm |
|---|---|---|---|---|---|---|---|
| 301 | 100% | check | check | 110% | 113% | 60% | 42% |
| 302 (inv) | 63% | +1.1 | +3.0 | 111% | 116% | 70% | 60% |
| 303 (inv) | 68% | +0.7 | +3.0 | 110% | 115% | 82% | 53% |

Photographic Samples 301 through 303 were evaluated in a manner analogous to that described in Photographic Example 2 above except that the attributes of Again, the inventive samples provide a high degree of sharpness enhancement with a minimum of sensitivity loss. Compounds used in preparing these samples include:

C-1

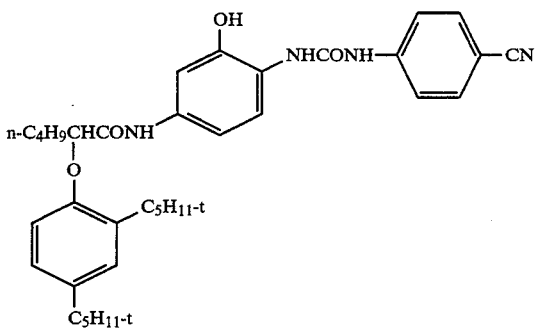

C-2

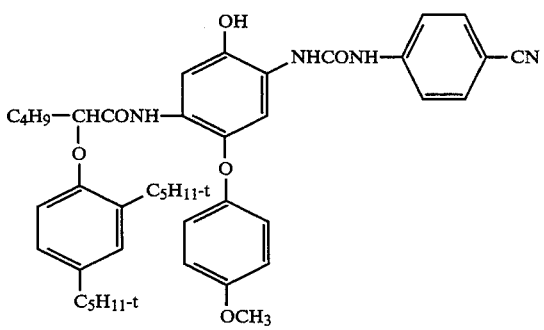

M-2

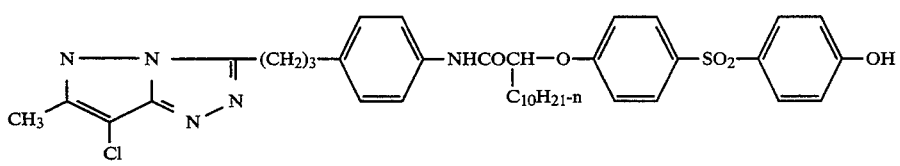

M-1

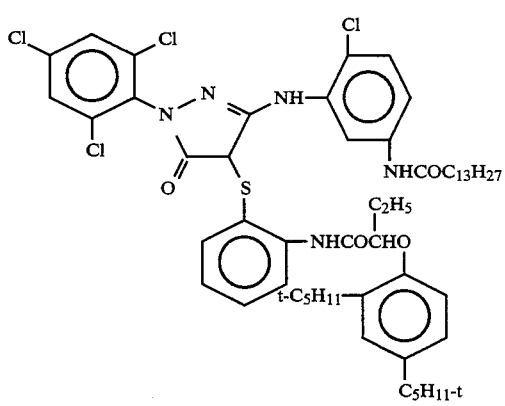

-continued

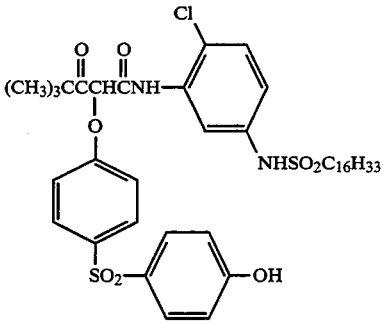

Y-1

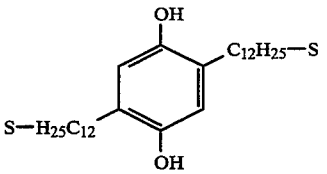

S-1

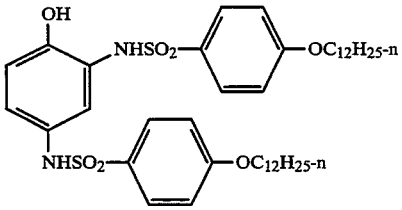

S-2

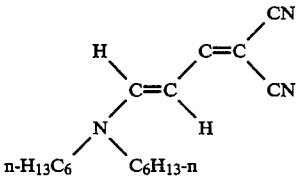

UV-1

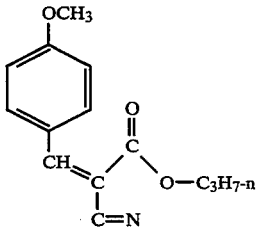

$CH_2(SO_2CH{=}CH_2)_2$

H-1

The invention has been described in detail with particular reference to preferred embodiments thereof, but it will be understood that variations and modifications can be effected within the spirit and scope of the invention.

I claim:

1. A photographic element comprising a support bearing at least two light sensitive silver halide emulsion layers wherein:

said layers are sensitive to the same region of the electromagnetic spectrum; and a more light sensitive layer of said at least two light sensitive silver halide emulsion layers is closer to an exposure source than a less light sensitive layer of said at least two light sensitive silver halide layers, said more light sensitive layer and said less light sensitive layer are sensitive to the same region of the electromagnetic spectrum, and;

said less light sensitive layer comprises a spatially fixed absorber dye that absorbs light in substantially the same region of the electromagnetic spectrum as said light sensitive silver halide; wherein said spatially fixed absorber dye does not substantially contribute to the spectral sensitivity of said less sensitive silver halide emulsion layer, and the thickness of said element above the support is between 5 and 30 microns.

2. A color photographic element according to claim 1 comprising image dye forming couplers.

3. The element of claim 1 wherein said element comprises three or more silver halide layers each sensitive to the same region of the electromagnetic spectrum.

4. The element of claim 1 comprising:

a red light sensitive color record comprising a red light sensitized silver halide emulsion having in reactive association a cyan dye forming image coupler;

a green light sensitive color record comprising a green light sensitized silver halide emulsion having in reactive association a magenta dye forming image coupler; and a blue light sensitive color record further comprising a blue light sensitized silver halide emulsion having in reactive association a yellow dye forming image coupler.

5. The element of claim 1 wherein at least one of said two light sensitive silver halide emulsion layers comprises tabular grains having an aspect ratio greater than about 2.

6. The element of claim 1 wherein said spatially fixed absorber dye absorbs red, green or blue light.

7. The element of claim 1 comprising a development inhibitor releasing compound;

said compound enabling release of a development inhibitor as a result of photographic processing.

8. The element of claim 1 comprising a development inhibitor releasing coupler;

said coupler enabling release of a development inhibitor as a result of a coupling reaction with an oxidized form of a paraphylene diamine developing agent.

9. The element of claim 1 wherein at least one of said two light sensitive silver halide emulsion layers comprises grains having an aspect ratio greater than about 5.

10. The element of claim 1 wherein said light sensitive layers are both spectrally sensitized.

11. The element of claim 1 wherein said spatially fixed absorber dye enables a reduction in sensitivity of at least 1%.

12. The element of claim 1 wherein said spatially fixed absorber dye enables a reduction in sensitivity of at least 5%.

13. The element of claim 1 wherein said spatially fixed absorber dye enables a reduction in sensitivity of at least 20%.

14. The element of claim 1 comprising between 1 and 10 grams per square meter of total silver in said element.

15. The element of claim 1 where said silver halide layers are contiguous.

16. The element of claim 1 wherein said silver halide layers are separated by one or more intervening layers that may contain light sensitive silver halide emulsions.

17. The element of claim 1 wherein the quantity of said spatially fixed absorber dye contained in said less light sensitive layer is greater than the quantity of said spatially fixed dye contained in said more light sensitive layer.

18. The element of claim 17 wherein said more light sensitive layer contains essentially no spatially fixed dye.

19. The element of claim 1 wherein total silver in said element is less than about 7 grams per square meter.

20. The element of claim 1 wherein the thickness of said element above the support is less than 25 microns.

* * * * *